US007748864B1

(12) United States Patent
Woodell

(10) Patent No.: US 7,748,864 B1
(45) Date of Patent: Jul. 6, 2010

(54) SWITCHING DEVICE

(76) Inventor: Phillip Lynn Woodell, P.O. Box 340, Elgin, SC (US) 29405

( * ) Notice: Subject to any disclaimer, the term of this patent is extended or adjusted under 35 U.S.C. 154(b) by 211 days.

(21) Appl. No.: 12/146,803

(22) Filed: Jun. 26, 2008

Related U.S. Application Data

(60) Provisional application No. 61/023,222, filed on Jan. 24, 2008.

(51) Int. Cl.
*F21L 4/00* (2006.01)

(52) U.S. Cl. ..... 362/208; 362/108

(58) Field of Classification Search ..... 362/108, 362/208, 394
See application file for complete search history.

(56) References Cited

U.S. PATENT DOCUMENTS

| | | | | |
|---|---|---|---|---|
| 3,792,389 | A | 2/1974 | Murphy | |
| 4,152,755 | A | 5/1979 | Trosper et al. | |
| 4,760,504 | A | 7/1988 | Schaller et al. | |
| 4,780,704 | A | 10/1988 | Tommasini | |
| 6,802,621 | B2 | 10/2004 | Adeler | |
| 7,347,583 | B2 * | 3/2008 | Britt | 362/206 |
| 2005/0047118 | A1 | 3/2005 | Spahr et al. | |
| 2005/0121485 | A1 | 6/2005 | Spicer | |
| 2006/0065689 | A1 | 3/2006 | Johnson | |
| 2006/0250798 | A1 | 11/2006 | Herold | |
| 2007/0058364 | A1 | 3/2007 | Britt | |

* cited by examiner

*Primary Examiner*—David V Bruce
(74) *Attorney, Agent, or Firm*—B. Craig Killough

(57) ABSTRACT

A switch actuating holster and accompanying switched device. When the switched device is withdrawn from the holster, the holster causes the switch to be actuated. The switch has an A position and a B position. The holster has a magnet that is positioned adjacent to the switch of the electrical device. As the device is withdrawn from the holster, the magnet of the holster pulls the switch to a B position and against the stop. As the device is inserted into the holster, the magnet of the holster pushes the magnet of the device against a stop in the A position. The switch may also be manually actuated.

11 Claims, 1 Drawing Sheet

SWITCHING DEVICE

This application claims priority to, and the benefit of, provisional application Ser. No. 61/023,222 filed Jan. 24, 2008.

FIELD OF THE INVENTION

This invention relates to switches generally, and is more particularly directed to switchable devices that are contained in cases, holsters, and similar holders.

BACKGROUND OF THE INVENTION

Many devices, and particularly electrical devices, have switches that are used to control functions. Most electrical devices, including portable battery powered electrical devices, have, at a minimum, power, or on-off, switches. Frequently, such switches are manually actuated.

Many of these devices are contained in holsters or similar carriers. Particularly with portable battery powered devices, the devices are placed in holsters that are worn on a belt of a user. The device is withdrawn from the holster and the switch is actuated to supply operating power to the device, or to control other operating functions of the device.

A common example of an electrically powered device that is carried in a holster or similar carrier is a flashlight. The flashlight is placed in a holster which is worn on a belt of a user. The flashlight may be withdrawn, and manually switched on, or off, by the user.

There is a need for a holster or similar carrier that will actuate a switch when the article carried in the holster is withdrawn from the holster. Law enforcement officers, security officers, military personnel, firemen, and others who carry flashlights should be able to withdrawal a flashlight from a holster without fumbling to locate the on-off switch. These persons must be alert to their surroundings, and it is advantageous for the user to keep his or her eyes on the surroundings, without having to visually locate the switch on a flashlight, and subsequently manually actuating the switch. This process is distracting and time consuming, and could cause attention to be diverted away from a danger, even though it may take only a second or two to locate a switch on a flashlight, and actuate the switch. This time could be critical to a particular exigent circumstance.

Other devices that are retained in holsters or similar holders or carriers would also be improved if a switch were automatically actuated when the device is removed from the holster or similar carrier.

SUMMARY OF THE INVENTION

The present invention is a holster and accompanying switched device. When the device is withdrawn from the holster, the holster causes the switch to be actuated. The switch has an A position and a B position, with stops associated with the A and B positions. The holster has a magnet that is positioned adjacent to the switch, which also has a magnet in it, of the electrical device. The device is placed within the holster with the switch positioned adjacent to the magnet of the holster when the device is fully inserted into the holster. As the device is withdrawn from the holster, the magnet of the holster pulls the switch to a B via magnetic attraction position and against the stop. As the device is inserted into the holster, the magnet of the holster pushes the magnet of the device against a stop in the A position. The switch may also be manually actuated.

DESCRIPTION OF DRAWING FIGURES

DESCRIPTION OF THE PREFERRED EMBODIMENTS

Figure 1:
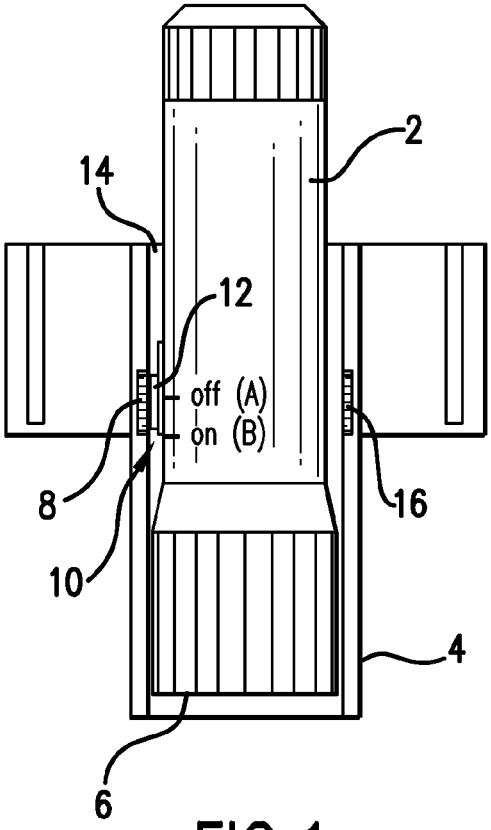
FIG. 1 is an elevation of a preferred embodiment of the invention showing a flashlight is a holster, with the holster cut away to reveal the engagement of the flashlight with the holster.

FIG. 1 shows a flashlight 2 in a holster 4. A flashlight is used for demonstration purposes, and is a preferred embodiment of the present invention. Other devices having, or that are adaptable to, sliding switches may be used with the invention, such as power tools. As shown in FIG. 1, the flashlight is fully engaged in the holster; that is, the flashlight is pushed so that the lighted end 6 of the flashlight comes to rest against the bottom of the receptacle of the holster.

As shown in FIG. 1, a magnet 8 of the holster is adjacent to the switch 10 of the flashlight. The switch also has a magnet 12 that is attracted to the magnet of the holster. The switch is in the off, or A, position.

The holster is preferred to have a guide, which could be a groove 14 or similar guide that engages the switch or other structure on the flashlight that acts as a tongue. This engagement orients the flashlight to cause the switch to be adjacent to the magnet when the flashlight is fully in the holster. The holster as shown in the drawing figure has magnets 8, 16 on opposing sides, so that the flashlight may be rotated 180 degrees for insertion into the holster and accomplish the goals of the invention. Magnets may be positioned at other locations on the holster to allow the flashlight to be otherwise rotated, and still accomplish the goals of the invention. The magnets may be neodymium magnets.

Figure 2:
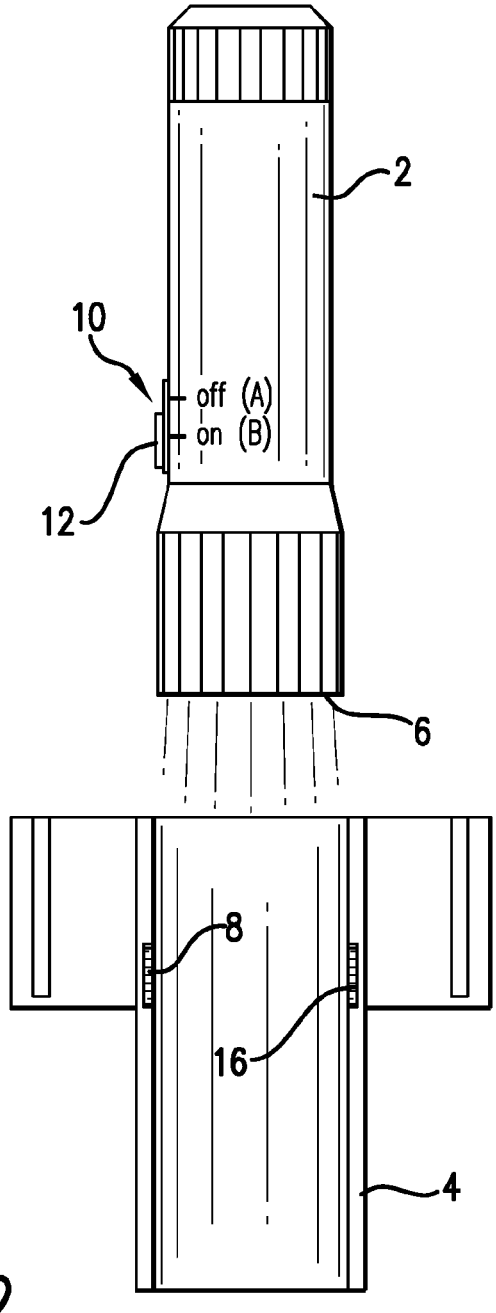
FIG. 2 shows the holster and flashlight of FIG. 1, demonstrating the flashlight withdrawn from the holster.

FIG. 2 shows the flashlight withdrawn from the holster. As the flashlight is withdrawn from the holster, the switch of the flashlight is attracted to the switch of the holster. This magnetic attraction and pull between the magnets causes the flashlight to move from the off, or A, position to the on, or B position as the flashlight is withdrawn from the holster. As the flashlight is withdrawn from the holster, the pull of the holster magnet against the magnet of the switch moves the switch from the A position to the B position. As the flashlight is withdrawn from the holster, the flashlight is turned on by movement of the switch actuated by the magnets. The flashlight may now be used in its normal manner.

Since the flashlight is turned on the by the magnetic attraction of the magnet of the holster and the magnet of the flashlight, the flashlight is ready for use without the user having to locate the switch and manipulate the switch. This function prevents the user from having to take his or her eyes off of the surroundings so as to locate and manually manipulate the switch. Since the switch is preferred to be a slide switch in the present invention, the switch may be manipulated by manually sliding it from the A position to the B position, and from the B position back to the A position, so that the flashlight or other device may be turned on or off apart from actuation by the holster.

When the flashlight is reinserted into the holster, the magnet of the flashlight again comes into proximity of the magnet of the holster as directed by the guide. As the flashlight is pushed to the full downward position against the bottom of the holster, the magnet of the flashlight is attracted to the magnet of the holster, which causes the magnet of the flashlight to be pushed to the off, or B, position by the insertion of the flashlight into the holster. The magnet of the holster is positioned relative to the magnet of the flashlight so that the switch will be pushed to the off position as the flashlight is fully inserted into the holster, and will be pulled back to the on position as the flashlight is removed from the holster.

A locking mechanism for the switch may be provided so that the switch is not actuated by the holster.

The device could be used with other objects that have switches, and particularly those objects that have slide switches that may be actuated by passing magnets, with one magnet located in a holster or similar holder or carrier, and the other magnet located on a slide switch of a device. The switch need not be an on/off switch, but may be a switch that actuates other functions of a device. Most commonly, the switch will be an electrical switch, and particularly, an electrical switch for battery powered devices.

What is claimed is:

1. A magnetically actuated switching device, comprising:

a holster comprising a magnet;

an electrical device comprising a switch;

said switch comprising a magnet, wherein said electrical device is oriented within said holster so that said magnet of said switch moves past said magnet of said holster and within a magnetic field of said magnet of said holster as said electrical device is inserted into and withdrawn from said holster so that said magnet of said holster moves said magnet of said switch and moves said switch of said electrical device from a first position to a second position as said electrical device is inserted into said holster.

2. A magnetically actuated switching device as described in claim 1, wherein said magnet of said holster moves said magnet of said switch and said switch of said electrical device from said second position to said first position as said electrical device is withdrawn from said holster.

3. A magnetically actuated switching device as described in claim 1, wherein said holster comprises a guide that orients said electrical device within said holster so that said magnet of said switch moves past said magnet of said holster and within a magnetic field of said holster as said electrical device is inserted into and is withdrawn from said holster so that said magnet of said holster moves said magnet of said switch and moves said switch from a first position to a second position as said electrical device is inserted into said holster.

4. A magnetically actuated switching device as described in claim 3, wherein said guide is a track, and wherein said electrical device engages said track.

5. A magnetically actuated switching device as described in claim 1, wherein said electrical device is a flashlight, and wherein said first position of said switch is a closed position and said second position of said switch is an open position.

6. A magnetically actuated switching device as described in claim 2, wherein said electrical device is a flashlight, and wherein said first position of said switch is a closed position and said second position of said switch is an open position.

7. A magnetically actuated switching device as described in claim 4, wherein said track is a groove.

8. A magnetically actuated switching device as described in claim 1, said holster further comprising a second magnet, and wherein said electrical device is oriented within said holster so that said magnet of said switch moves past said second magnet of said holster and within a magnetic field of said magnet of said holster as said electrical device is inserted into and removed from said holster so that said second magnet of said holster moves said magnet of said switch and said switch from a first position to a second position as said electrical device is inserted into said holster.

9. A magnetically actuated switching device as described in claim 8, wherein said holster comprises a guide that orients said electrical device within said holster so that said magnet of said switch moves past one of said first magnet of said holster and said second magnet of said holster and within a magnetic field of said holster as said electrical device is inserted into and withdrawn from said holster so that one of said first magnet of said holster and said second magnet of said holster moves said magnet of said switch and moves said switch of said electrical device from a first position to a second position as said electrical device is inserted into said holster.

10. A magnetically actuated switching device as described in claim 9, wherein said first magnet of said holster is oriented at approximately 180 degrees from said second magnet of said holster.

11. A magnetically actuated switching device as described in claim 1, wherein said switch is a slide switch, and wherein said slide switch slides as said magnet of said switch is moved by magnetic attraction to said magnet of said holster.

* * * * *